United States Patent [19]

Tell

[11] 4,130,142

[45] Dec. 19, 1978

[54] LOOP PICKER

[75] Inventor: Mayo B. Tell, Asheville, N.C.

[73] Assignee: Dayco Corporation, Dayton, Ohio

[21] Appl. No.: 858,920

[22] Filed: Dec. 9, 1977

[51] Int. Cl.[2] ..... D03D 49/36

[52] U.S. Cl. ..... 139/159

[58] Field of Search ..... 139/159, 160, DIG. 1, 139/383 R

[56] References Cited

U.S. PATENT DOCUMENTS

| | | | |
|---|---|---|---|
| Re. 28,155 | 9/1974 | Dow | 139/383 R |
| 1,368,215 | 2/1921 | Stewart | 139/DIG. 1 |
| 1,603,982 | 10/1926 | Riley | 139/DIG. 1 |
| 2,786,492 | 3/1957 | West, Jr. | 139/159 |
| 3,332,450 | 7/1967 | Bowling et al. | 139/159 |
| 3,874,422 | 4/1975 | Dow | 139/383 R |
| 3,990,482 | 11/1976 | Bayer | 139/159 |

OTHER PUBLICATIONS

Modern Textiles, Triaxial Weaving, Jun. 1977, pp. 12, 13 & 22.

*Primary Examiner*—James Kee Chi

*Attorney, Agent, or Firm*—Reuben Wolk

[57] ABSTRACT

In a loop picker having at least one face block and a plurality of laminated fabric layers including laminated fabric layers disposed around the face block and laminated fabric layers defining a picker stick receiving passage, the improvement wherein at least one of the face block and plurality of laminated layers is made of a triaxial fabric.

19 Claims, 8 Drawing Figures

LOOP PICKER

BACKGROUND OF THE INVENTION

It is known in the weaving art to employ looms which utilize a freely traveling shuttle to carry a weft thread transversely of warp threads of woven material, and ordinarily motion is imparted to such a shuttle as a result of impact of such shuttle against a so-called loop picker. Each of these loop pickers is usually attached at the end of a picker stick and each stick is activated by the loom so as to allow the loop picker to absorb the impact of the oncoming shuttle and immediately thereafter to strike the shuttle so as to impart sufficient force thereto to send it in an opposite direction.

Accordingly, it will be appreciated that there is repeated impact of the shuttle striking the loop picker causing vibration of the picker, the picker stick, and causing considerable wear of such picker.

It has been proposed heretofore in U.S. Pat. Nos. 2,786,492 and 3,332,450, for example, to construct a picker of various combinations of fabric and cushioning layers in an effort to cushion the impact between the shuttle and the picker. However, there has been no effort heretofore to provide a picker made of fabric material which is substantially impenetrable by a shuttle in an effort to improve the wear and impact-absorbing properties of such picker.

SUMMARY

It is a feature of this invention to provide a loop picker having component portions thereof made of woven fabric materials which provide improved wear and impact-absorbing properties for such picker.

Another feature of this invention is to provide a loop picker of the character mentioned which utilizes a triaxial fabric in one or more portions thereof.

Another feature of this invention is to provide a loop picker of the character mentioned which provides improved wear resistance generally of the order of 300–400 percent better than loop pickers proposed heretofore employing ordinary non-triaxial fabrics.

Another feature of this invention is to provide in a loop picker having at least one face block and a plurality of laminated fabric layers including laminated fabric layers disposed around the face block and laminated layers defining a picker stick receiving passage which has a central longitudinal axis, the improvement wherein at least one of the face block and plurality of laminated layers is made of triaxial fabric.

Therefore, it is an object of this invention to provide an improved loop picker having one or more of the novel features set forth above or hereinafter shown or described.

Other objects, features, details, uses, and advantages of this invention will become apparent from the embodiments thereof presented in the following specifications, claims, and drawings.

BRIEF DESCRIPTION OF THE DRAWINGS

The accompanying drawings show present preferred embodiments of this invention, in which.

DESCRIPTION OF ILLUSTRATED EMBODIMENTS

Figure 1:
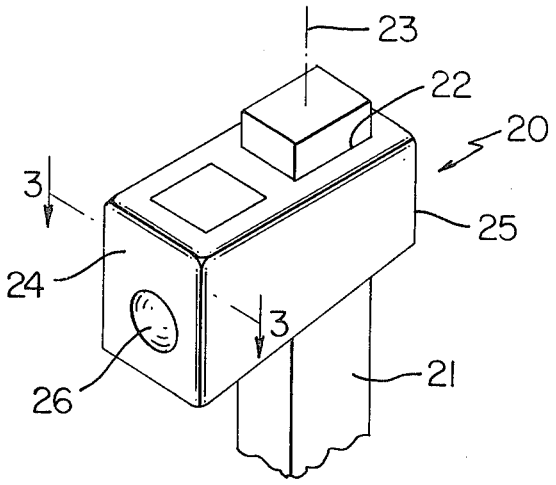
FIG. 1 is a fragmentary perspective view illustrating one exemplary embodiment of a loop picker of this invention mounted on an associated picker stick.

Reference is now made to FIG. 1 of the drawings which illustrates one exemplary embodiment of a loop picker of this invention which is designated generally by the reference numeral 20 and such picker is shown mounted on a picker stick 21 which may be made of any suitable material such as wood; and, the stick 21 is inserted through a stick receiving passage 22 provided at the rear portion of the picker 20. The passage 22 has a central longitudinal axis 23; and, the picker has a substantially planar forward face 24 and a rear face 25 disposed substantially parallel to the forward face 24 with the forward face 24 having a recess 26 provided therein as is known in the art and the purpose of the recess 26 is for receiving the nose of an associated shuttle therewithin during impact of such shuttle against the picker 20.

Figure 3:
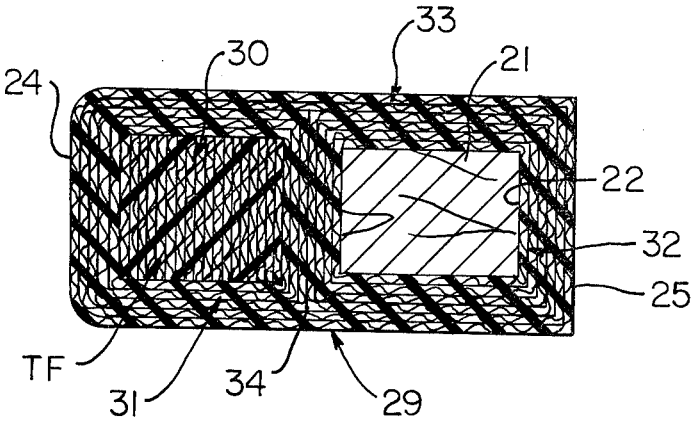
FIG. 3 is a cross-sectional view taken essentially on the line 3—3 of FIG. 1.
Figure 4:
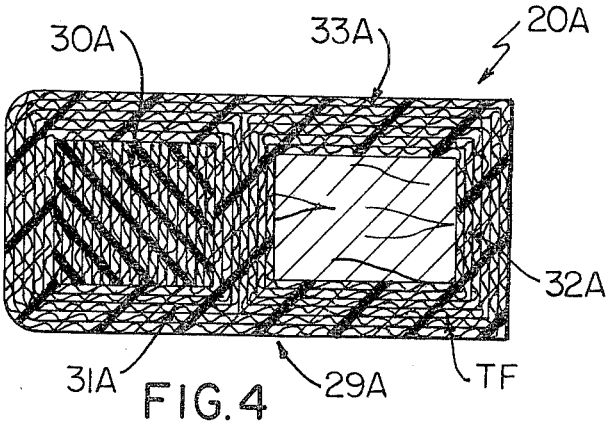
FIG. 4 is a view similar to FIG. 3 illustrating another exemplary embodiment of the loop picker of this invention.

Referring now to FIG. 3, it will be seen that the exemplary picker 20 has a face block 30 and a plurality of laminated fabric layers designated generally by the reference numeral 29 and including laminated fabric layers 31 disposed around the face block 30, laminated fabric layers 32 disposed rearwardly of the face block 30 and defining the picker stick receiving passage 22, and a plurality of outer layers 33 comprised of a fabric strip preferably wrapped in a plurality of turns with all surfaces of the strip being disposed substantially parallel to the longitudinal axis 23.

The laminated fabric layers 31, 32, and 33 are wound in accordance with techniques known in the art to define their associated portion of the loop picker. The fabric layers 31 and 32 are suitably bonded together on a common interface 34 with the outer layers 33 being suitably wound in position to complete the loop picker 20.

Figure 2:
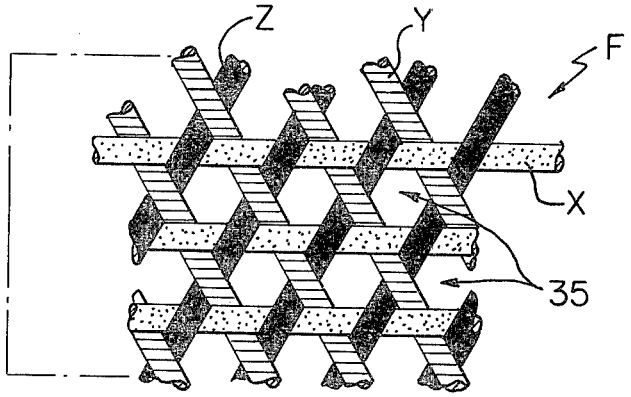
FIG. 2 is a fragmentary plan view of a typical triaxial fabric which may be employed in the picker of FIG. 1 and which may be employed in the other embodiments of the picker disclosed herein.

The face block 30 of the picker 20 is preferably made of a plurality of layers of triaxial fabric and in this example of the invention such layers are designated by the same reference numeral TF. The layers TF of triaxial fabric are laminated together in a mass having a rectangular cross-sectional configuration at any plane therethrough parallel as well as perpendicular to the axis 23. The layers TF in the face block 30 are cross-hatched in the drawings as being comprised of synthetic plastic material and this is intended to cover situations where all threads are of synthetic plastic or only some of threads. The fabric F may be of the type disclosed in detail in U.S. Pat. No. 3,446,251 which is incorporated herein by this reference thereto; and a typical example of the fabric disclosed in this patent is illustrated in FIG. 2 of the drawings. The exemplary fabric F of FIG. 2 has a plurality of three sets of yarn courses with the yarns of each set being disposed in parallel relation; and, the yarns of one set are shown in solid lines and referred to as the woof or Z yarns, the yarns of a second set are shown cross-hatched and referred to as the weft or Y yarns, and the yarns of the third set are with stipling therein and referred to as the warp or Z yarns.

The triaxial fabric TF has open spaces disposed between the various yarns thereof and as shown at 35 for example, and such open spaces 35 are uniformly and symmetrically spaced throughout the fabric and the fabric with such spaces lends itself to calendering, frictioning, skim coating, knife coating, and the like with a suitable thickness of polymeric material to thereby assure precise control of the overall fabric and the picker employing such fabric.

Other exemplary embodiments of the loop picker of this invention are illustrated in FIGS. 4, 5, 6, and 7–9 of the drawings. The loop pickers illustrated in FIGS. 4, 5, 6, and 7–9 are very similar to the loop picker 20; therefore, such loop pickers will be designated by the reference numerals 20A, 20B, 20C, and 20D and representative parts of the loop pickers which are similar to corresponding parts of the loop picker 20 will be designated in the drawings by the same reference numerals as in the loop picker 20 (whether or not such representative parts are mentioned in the specification) followed by the associated letter designation whether A, B, C, or D and not described again in detail.

The loop picker 20A has a face block 30A of ordinary construction; however, it has its plurality of laminated layers 29A defined by laminated layers 31A, 32A, and 33A made of triaxial fabric TF. The layers 29A of triaxial fabric TF are also cross-hatched in FIG. 4 of the drawings as being comprised of synthetic plastic material and in a similar manner as discussed earlier in connection with the face block 30 of picker 20 and this is intended to cover situations where all threads of layers 29A are of synthetic plastic material or only some of such threads.

Figure 5:
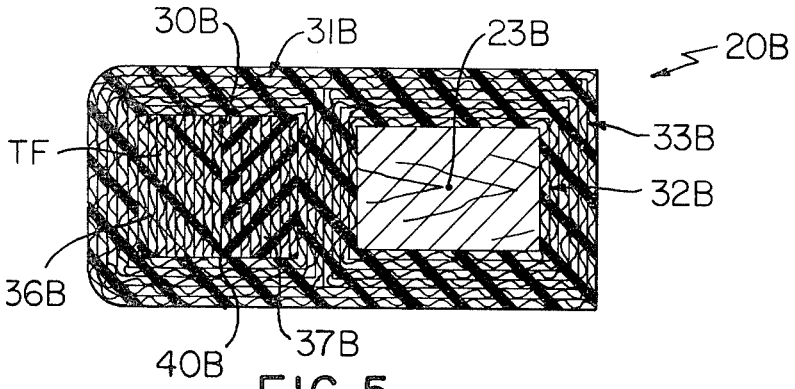
FIG. 5 is a view similar to FIG. 3 illustrating another exemplary embodiment of the loop picker of this invention.

The loop picker 20B of FIG. 5 has laminated fabric layers 31B, 32B, and 33B of standard construction; however, the face block 30B thereof is comprised of a forward portion 36B made of a plurality of laminated layers of triaxial fabric TF and a rear portion 37B made of laminated layers of any known fabric employed heretofore in loop pickers. The layers 36B and 37B define two block-like masses and each of such two masses is of rectangular cross-sectional outline when viewed on any cross-section parallel or perpendicular to the axis 23B. The block-like masses defined by portions 36B and 37B are bonded together on a common interface 40B. The forward portion 36B is cross-hatched as being of plastic and may be comprised with all of its threads of synthetic plastic material or only some of such threads.

Figure 6:
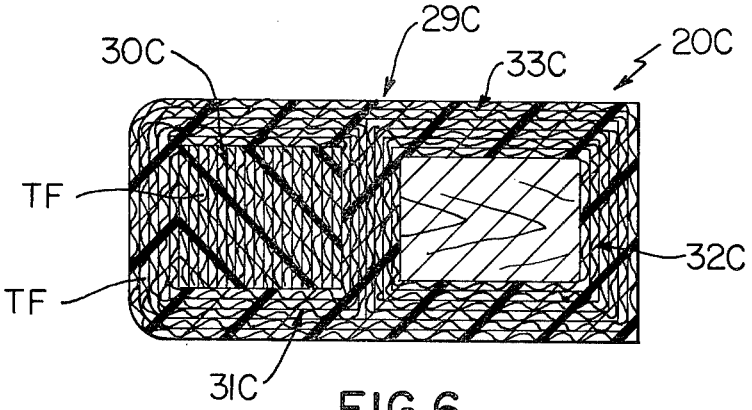
FIG. 6 is a view similar to FIG. 3 illustrating another exemplary embodiment of the loop picker of this invention.

The loop picker 20C of FIG. 6 has triaxial fabric TF defining its face block 30C and its laminated layers 29C comprised of layers 31C, 32C, and 33C, whereby all components of the loop picker 20C are triaxial fabric TF. The entire loop picker 20C is shown cross-hatched as plastic and as before this is intended to cover situations where all threads of such fabric layers are made of synthetic plastic material or only some of such threads.

Figure 7:
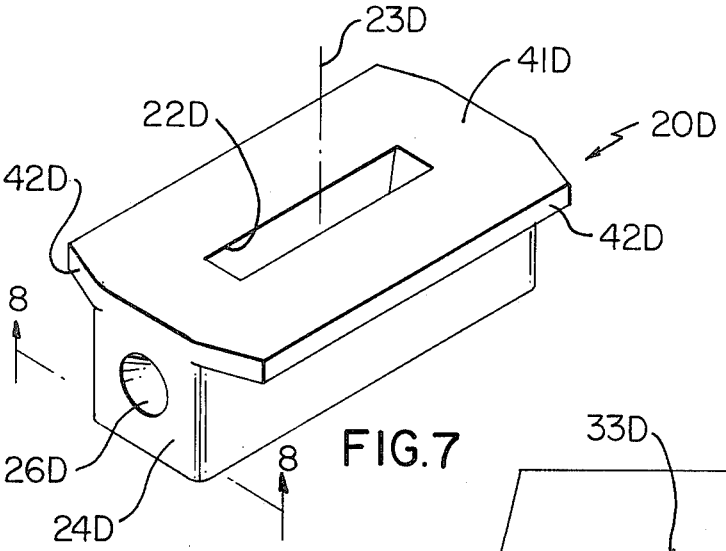
FIG. 7 is a perspective view of another exemplary embodiment of a loop picker minus its picker stick and also made in accordance with this invention.
Figure 8:
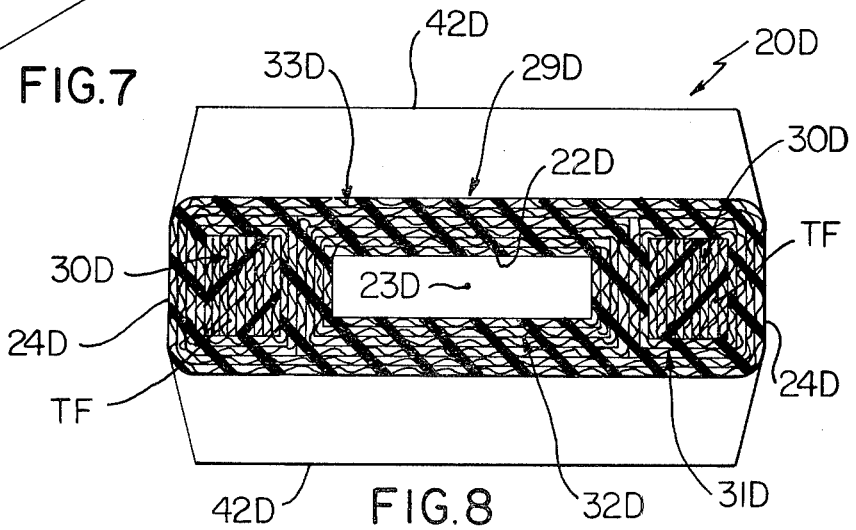
FIG. 8 is a view taken essentially on the line 8—8 of FIG. 7.

The loop picker 20D of FIGS. 7–9 is similar to the loop picker 20; however, the loop picker 20D has a plurality of two face blocks each designated 30D disposed at substantially diametrically opposite positions. The stick receiving passage 22D is disposed midway between the face blocks 30D.

The loop picker 20D has an upper top portion 41D provided with opposed side flanges 42D whereby the loop picker 20D is particularly adapted to be used in applications where movement thereof is in a rectangular path guided by the side flanges 42D. The loop picker 20D also has a pair of forward faces 24D each provided with an associated recess 26D therein in a similar manner as the forward face 24 and recess 26 of the loop picker 20.

Each face block 30D of picker 20D is made of a plurality of laminated layers of triaxial fabric TF. The layers TF of each face block 30D are shown by cross-hatching in the drawings as being made of synthetic plastic material; and, as explained earlier in connection with other disclosed embodiments of the picker this showing is intended to cover situations where all threads of each fabric layer are made of synthetic plastic material or only some of such threads.

The loop picker 20D has a plurality of laminated fabric layers 29D including laminated fabric layers 31D disposed around each face block 30D, laminated fabric layers 32D defining the picker stick receiving passage 22D, and a plurality of outer layers 33D. The layers 33D are preferably comprised of a fabric strip wrapped in a plurality of turns with all surfaces of the strip being disposed substantially parallel to the longitudinal axis 23D of the picker 20D. The layers 29D defined by fabric layers 31D, 32D, and 33D in this example are layers of fabric which is commonly used in pickers proposed heretofore.

In each disclosure of the loop picker presented in the drawings of this application at least one portion thereof is shown as being made of a triaxial fabric TF wherein the layers have been laminated together in a laminated construction which has been cross-hatched in the drawing as plastic. One of the reasons for presenting each loop picker in this manner is because of the simplicity of drawing presentation which facilitates distinguishing each portion from an adjacent component portion; however, it is to be understood that the triaxial fabric used to make one or more portions of each loop picker of this invention need not necessarily be comprised of all yarns or only some yarns or fabric portions made of synthetic plastic material. Indeed, the yarns or portions of each fabric may be made of other materials such as spun yarn of 100 percent cotton, or the like. Similarly, cotton filaments or yarn may be combined or blended with other synthetic plastic fibers, filaments, or yarns in any desired manner and percentage of each.

The synthetic plastic material employed in each loop picker of this invention may be any suitable synthetic plastic material which lends itself to weaving into a triaxial fabric. Preferably such material is in the form of nylon, polyester, or an aromatic polyamide in the form of aramid.

The triaxial fabric provided in the loop picker of this invention provides optimum reinforcement and improved impenatrability. It has been found that pickers employing triaxial fabric as disclosed herein have an improved service life which is generally of the order of 300–400 percent greater than previously proposed loop pickers.

Each loop picker disclosed herein may be made in accordance with any suitable manufacturing process known in the art. For example, the various layers comprising each of the component portions of each picker may be suitably assembled with polymeric material on opposed surfaces of each layer whereupon the picker may be assembled in its final configuration and suitably cured and cooled to complete the loop picker construction.

As previously mentioned the triaxial fabric TF of the loop picker 20 has open spaces 35 uniformly and symmetrically disposed throughout and such spaces and fabric enable the fabric to be calendered, frictioned, skim coated, knife coated, and the like. It will be appreciated that the triaxial fabric TF employed in all loop pickers disclosed herein has substantially identicial characteristics for the same reasons.

While present exemplary embodiments of this invention, and methods of practicing the same, have been illustrated and described, it will be recognized that this invention may be otherwise variously embodied and practiced within the scope of the following claims.

What is claimed is:

1. In a loop picker having at least one face block and a plurality of laminated fabric layers including laminated fabric layers disposed around said face block and laminated fabric layers defining a picker stick receiving passage which has a central longitudinal axis, the improvement wherein at least one of said face block and plurality of laminated layers is comprised of triaxial fabric, said triaxial fabric being defined by three angularly displaced sets of parallel courses of yarn interwoven to prevent slippage of at least one yarn course set along any other yarn course set.

2. A loop picker as set forth in claim 1 wherein said entire face block is made of said triaxial fabric.

3. A loop picker as set forth in claim 1 wherein said entire face block is made of a plurality of layers of said triaxial fabric laminated together in a mass having a rectangular cross-sectional configuration on any plane therethrough parallel as well as perpendicular to said axis.

4. A loop picker as set forth in claim 1 wherein said face block is made of a plurality of layers of said triaxial fabric adjoined by a plurality of layers of fabric other than said triaxial fabric.

5. A loop picker as set forth in claim 1 wherein said face block is made in two portions consisting of a forward portion made of a plurality of layers of said triaxial fabric laminated together in a mass having a rectangular crosssectional configuration on any plane therethrough parallel as well as perpendicular to said axis and a rear portion made of a plurality of layers of another fabric other than said triaxial fabric laminated together in a mass having a rectangular crosssectional configuration on any plane therethrough parallel as well as perpendicular to said axis, said portions being bonded together on a planar interface parallel to said axis.

6. A loop picker as set forth in claim 1 wherein said laminated layers are made of said triaxial fabric.

7. A loop picker as set forth in claim 1 wherein said laminated layers are comprised of fabric strip wrapped in at least one turn around said loop picker with said turn having all surfaces thereof disposed substantially parallel to said axis.

8. A loop picker as set forth in claim 7 wherein said fabric strip is wrapped in a plurality of turns around said loop picker and having an outer turn disposed with all surfaces thereof parallel to said axis and defining the corresponding outer surfaces of said loop picker.

9. A loop picker as set forth in claim 1 wherein said face block and said laminated layers are comprised of said triaxial fabric.

10. A loop picker as set forth in claim 1 and further comprising another face block disposed at a substantially diametrically opposite position from said first-named face block, said picker stick receiving passage being disposed between said face blocks with said face blocks and plurality of laminated layers arranged in a symmetrical manner around said passage.

11. In loop picker having at least one face block and a plurality of laminated fabric layers including laminated fabric layers defined by a strip wound around said face block and laminated fabric layers defined by another strip wound with turns thereof in adjoining relation to define a picker stick receiving passage which has a central longitudinal axis, the improvement wherein at least one of said face block and plurality of laminated layers is comprised of triaxial fabric, said triaxial fabric being defined by three angularly displaced sets of parallel courses of yarn interwoven to prevent slippage of at least one yarn course set along any other yarn course set.

12. A loop picker as set forth in claim 11 wherein said face block is comprised of a plurality of layers of said triaxial fabric laminated together in a mass having a rectangular cross-sectional configuration on any plane therethrough parallel as well as perpendicular to said axis.

13. A loop picker as set forth in claim 11 wherein said triaxial fabric is comprised of a synthetic plastic material.

14. A loop picker as set forth in claim 13 wherein said synthetic plastic material is nylon.

15. A loop picker as set forth in claim 13 wherein said synthetic plastic material is a polyester.

16. A loop picker as set forth in claim 13 wherein said synthetic plastic material is an aromatic polyamide in the form of aramid.

17. A loop picker as set forth in claim 11 wherein said triaxial fabric is comprised of a spun yarn of 100 percent cotton.

18. A loop picker as set forth in claim 11 wherein said triaxial fabric is comprised of synthetic plastic material blended with cotton.

19. A loop picker as set forth in claim 13 wherein said triaxial fabric is comprised of material from the group consisting of cotton, nylon, polyester, and aramid, said triaxial fabric providing an improved service life generally of the order of 300–400 percent greater than ordinary pickers made without said triaxial fabric.

* * * * *